US006758414B2

(12) United States Patent
Reusing

(10) Patent No.: US 6,758,414 B2
(45) Date of Patent: Jul. 6, 2004

(54) FUEL INJECTION DEVICE FOR AN INTERNAL COMBUSTION ENGINE

(75) Inventor: Volker Reusing, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 224 days.

(21) Appl. No.: 10/147,086

(22) Filed: May 17, 2002

(65) Prior Publication Data

US 2002/0170537 A1 Nov. 21, 2002

(30) Foreign Application Priority Data

May 17, 2001 (DE) ..... 101 23 994

(51) Int. Cl.[7] ..... F02M 59/00; F02M 39/00; B05B 1/30

(52) U.S. Cl. ..... 239/533.2; 239/533.3; 239/533.8; 239/585.1; 239/585.5

(58) Field of Search ..... 239/533.2, 533.3, 239/533.7, 533.8, 533.9, 88–93, 95, 96, 585.1, 585.2, 585.3, 585.4, 585.5; 251/129.15, 129.21

(56) References Cited

U.S. PATENT DOCUMENTS 4,856,713 A * 8/1989 Burnett ..... 239/113
5,494,219 A * 2/1996 Maley et al. ..... 239/88
5,964,192 A * 10/1999 Ishii ..... 123/90.11
6,065,684 A * 5/2000 Varble et al. ..... 239/5
6,073,862 A * 6/2000 Touchette et al. ..... 239/408
6,199,533 B1 * 3/2001 Morris et al. ..... 123/299

FOREIGN PATENT DOCUMENTS

EP 0 823 549 A2 8/1997
EP 1 211 411 A2 11/2001

* cited by examiner

*Primary Examiner*—Davis D Hwu
(74) *Attorney, Agent, or Firm*—Ronald E. Greigg

(57) ABSTRACT

A fuel injection device having a fuel pump for each cylinder of an internal combustion engine, which fuel pump has a pump piston that is driven in a stroke motion by the engine and delimits a pump working chamber, which is connected to a fuel injection valve that constitutes a structural unit with the fuel pump and has an injection valve member, which controls at least one injection opening and can be moved in the opening direction counter to a closing force by the pressure generated in the pump working chamber. A first electrically actuated control valve controls a connection of the line to a discharge chamber. A second electrically actuated control valve controls a connection of a control pressure chamber of the fuel injection valve to the pump working chamber, by means of which the injection valve member is at least indirectly acted on in the closing direction. The two control valves are actuated by a shared actuator, which controls the pressure prevailing in an actuator pressure chamber, which pressure acts on the respective valve members of the control valves.

18 Claims, 2 Drawing Sheets

FUEL INJECTION DEVICE FOR AN INTERNAL COMBUSTION ENGINE

BACKGROUND OF THE INVENTION

1. Field of the Invention

The invention is directed from improved fuel injection device for an internal combustion engine and more particularly to such a fuel injection device having a fuel pump and fuel injection valve comprising a structural unit for each engine cylinder.

2. Description of the Prior Art

A fuel injection device of this kind has been disclosed by EP 0 823 549 A. For each cylinder of the internal combustion engine, this fuel injection device has a fuel pump and a fuel injection valve, which comprise a single structural unit. The fuel pump has a pump piston, which is driven in a stroke motion by the engine and delimits a pump working chamber. A first electrically actuated control valve is provided, which controls a connection of the pump working chamber to a discharge chamber. The fuel injection valve has an injection valve member, which controls at least one injection opening and which, through the pressure prevailing in a pressure chamber connected to the pump working chamber, can be moved in the opening direction, counter to a closing force. A second electrically actuated control valve is provided, which controls the pressure prevailing in a control pressure chamber of the fuel injection valve and which acts at least indirectly on the injection valve member in the closing direction. The second control valve controls a connection of the control pressure chamber to the pump working chamber. This fuel injection device permits a preinjection of a small fuel quantity, a main injection of a large fuel quantity, and a secondary injection of a small fuel quantity to be produced in sequence in an injection cycle. A shared actuator in the form of an electromagnet actuates both control valves. In order for this to be possible, the two valves must be disposed axially in relation to each other, which gives the structural unit comprising the fuel pump and fuel injection valve a large overall height.

OBJECT AND SUMMARY OF THE INVENTION

The fuel injection device according to the invention has the advantage over the prior art that the two control valves can be arbitrarily positioned, for example next to each other, so that the structural unit comprising the fuel pump and the fuel injection valve only has a small overall height.

Other advantageous embodiments and improvements of the fuel injection device according to the invention are disclosed including an embodiment which permits a fuel injection that has a stepped pressure increase.

BRIEF DESCRIPTION OF THE DRAWINGS

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
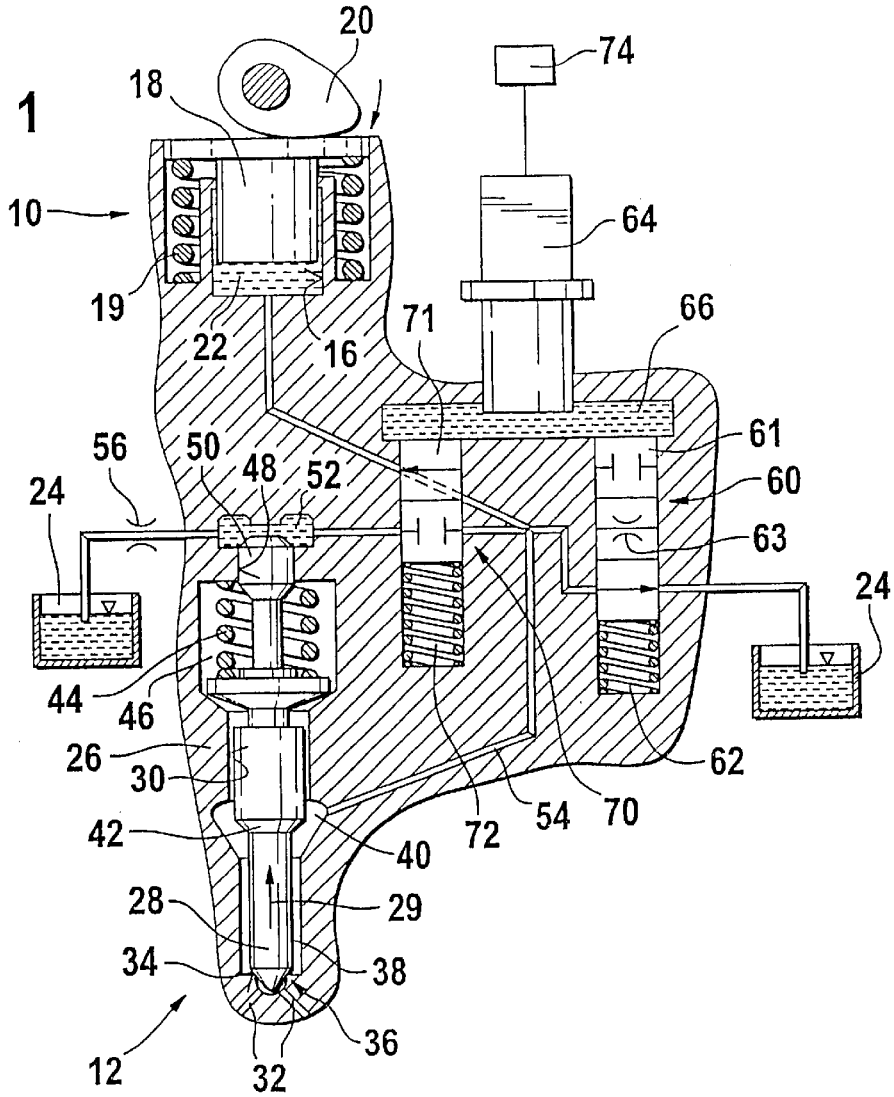
FIG. 1 schematically depicts a fuel injection device for an internal combustion engine, FIG. 2 plots a march of pressure at injection openings of a fuel injection valve of the fuel injection device.
Figure 3:
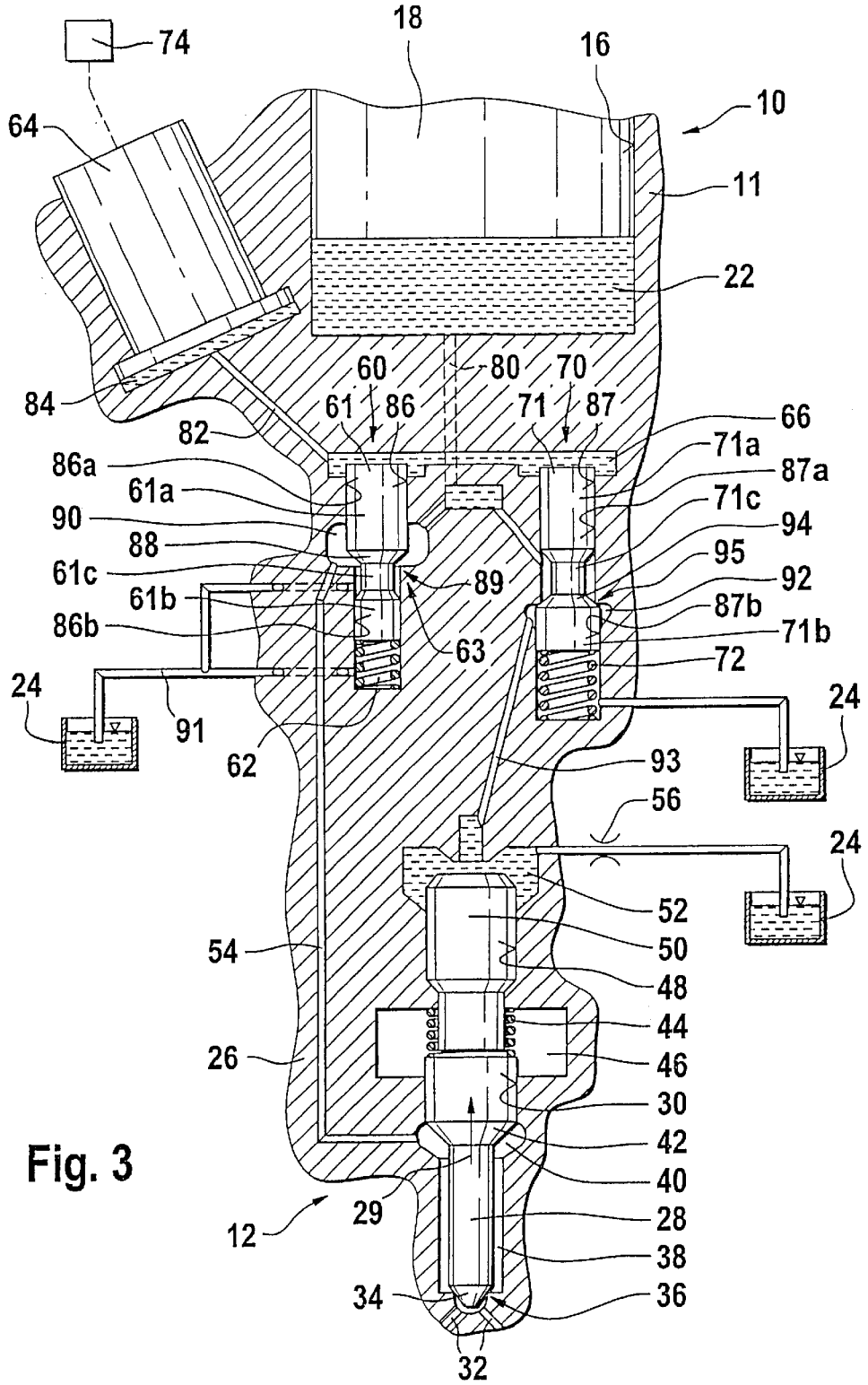
FIG. 3 shows a longitudinal section through the fuel injection device.

FIGS. 1 and 3 show a fuel injection device for an internal combustion engine of a motor vehicle. The fuel injection device is embodied as a so-called unit fuel injector system and for each cylinder of the engine, has a respective fuel pump 10 and a fuel injection valve 12, which comprise a structural unit. The fuel pump 10 has a pump piston 18, which is guided in a sealed fashion in a cylinder 16 and can be set into a stroke motion by a cam 20 of a camshaft of the engine, counter to the force of a restoring spring 19. In the cylinder 16, the pump piston 18 delimits a pump working chamber 22 in which fuel is compressed at high pressure by the pump piston 18. The pump working chamber 22 is supplied with fuel from a fuel tank 24, for example by means of a low-pressure pump, not shown.

The fuel injection valve 12 is situated downstream of the fuel pump 10 toward the combustion chamber of the engine, and is connected to the pump working chamber 22. The fuel injection valve 12 has a valve body 26, which can be comprised of multiple parts, in which a piston-shaped injection valve member 28 is guided so that it can move longitudinally in a bore 30. In its end region oriented toward the combustion chamber of the engine cylinder, the valve body 26 has at least one, preferably several, injection openings 32. In its end region oriented toward the combustion chamber, the injection valve member 28 has a sealing surface 34, for example approximately conical in shape, which cooperates with a valve seat 36 embodied in the valve body 26, from which or downstream of which the injection openings 32 lead. In the valve body 26, between the injection valve member 28 and the bore 30 toward the valve seat 36, an annular chamber 38 is provided, which transitions via a radial enlargement of the bore 30 into a pressure chamber 40 that encompasses the injection valve member 28. The injection valve member 28 has a pressure shoulder 42 in the vicinity of the pressure chamber 40. The end of the injection valve member 28 oriented away from the combustion chamber is engaged by a prestressed closing spring 44, which pushes the injection valve member 28 toward the valve seat 36. The closing spring 44 is disposed in a spring chamber 46 of the valve body 26, which adjoins the bore 30. At the end oriented away from the bore 30 in the valve body 26, the spring chamber 46 adjoins another bore 48, in which a piston 50 is guided in a sealed fashion, which is connected to the injection valve member 28. With its end face oriented away from the spring chamber 46, the piston 50 delimits a control pressure chamber 52 in the valve body 26. The pressure chamber 40 is connected to the pump working chamber 22 by means of a conduit 54 that extends through the valve body 26. The control pressure chamber 52 has a continuously open connection to a discharge chamber, which function is filled, for example, by the fuel tank 24, and which contains at least one throttle restriction 56.

The fuel injection device has two electrically actuated control valves 60, 70, which are situated in the structural unit comprised of the fuel pump 10 and the fuel injection valve 12. A first control valve 60 controls a connection of the pump working chamber 22 to a discharge chamber, the discharge chamber being comprised, for example, by the fuel tank 24 or another region in which a low pressure prevails. The first control valve 60 can be embodied as a 2/2-port directional-control valve or preferably as a 2/3-port directional-control valve. The first control valve 60 has a valve member 61, which can be moved counter to the force of a restoring spring 62, between two switching positions when embodied as a 2/2-port directional-control valve, and between three switching positions when embodied as a 2/3-port directional-control valve.

The second control valve 70 controls a connection of the control pressure chamber 52 of the fuel injection valve 12 to the pump working chamber 22. The second control valve 70 is embodied as a 2/2-port directional-control valve and has a valve member 71 that can be moved counter to the force of a restoring spring 72, between two switching positions.

The two control valves 60, 70 are controlled by a shared actuator 64, which controls the pressure in an actuator pressure chamber 66. The actuator 64 can, for example, be a piezoelectric actuator, which changes in length depending on an electrical voltage that is applied to it. If no voltage is applied to the actuator 64, then it assumes its shortest length and the pressure in the actuator pressure chamber 66 is low. As increasing electrical voltage is applied to the actuator 64, its length increases and the pressure in the actuator pressure chamber 66 increases. The valve member 61 of the first control valve 60 is acted on at one end by the pressure in the actuator pressure chamber 66 and is acted on at the other end by the force of the prestressed restoring spring 62. With a low pressure in the actuator pressure chamber 66, the first control valve 60, due to the force of the restoring spring 62 acting on its valve member 61, is disposed in a first switching position, in which the pump working chamber 22 is connected to the fuel tank 24. In order to switch the first control valve 60 into a second or third switching position, the actuator 64 has an electrical voltage applied to it, which is powerful enough to produce a sufficient pressure in the actuator pressure chamber 66 for the force that it exerts on the valve member 61 to exceed the force of the restoring spring 62, thus moving the valve member 61 into another switching position. If the first control valve 60 is embodied as a 2/3-port directional-control valve, in a second switching position, it connects the pump working chamber 22 to the discharge chamber 24 via a throttle restriction 63. The first control valve 60 is brought into its second switching position in that through appropriate activation of the actuator 64, the pressure in the actuator pressure chamber 66 is increased in such a way that the force of pressure acting on the valve member 61 causes it to execute the stroke necessary to reach the second switching position, counter to the force of the restoring spring 62. In its third switching position, the first control valve 60 shuts off the connection between the pump working chamber 22 and the discharge chamber 24. The first control valve 60 is brought into its third switching position in that through appropriate activation of the actuator 64, the pressure in the actuator pressure chamber 66 is further increased in such a way that the force of pressure acting on the valve member 61 causes it to execute the further stroke necessary to reach the third switching position, counter to the force of the restoring spring 62.

The second control valve 70 likewise has a valve member 71, which is acted on at one end by the pressure in the actuator pressure chamber 66 and is acted on at the other end by the force of the prestressed restoring spring 72. With a low pressure in the actuator pressure chamber 66, the control valve 70, due to the force of the restoring spring 72 acting on its valve member 71, is disposed in a first switching position, in which the control pressure chamber 52 is shut off from the pump working chamber 22. In order to switch the second control valve 70 into its second switching position in which the control pressure chamber 52 is connected to the pump working chamber 22, the actuator 64 has an electrical voltage applied to it, which is powerful enough to produce a sufficient pressure in the actuator pressure chamber 66 for the force that it exerts on the valve member 71 to exceed the force of the restoring spring 72, thus causing the valve member 71 to execute a stroke motion into its second switching position.

The force exerted by the restoring spring 72 on the valve member 71 of the second control valve 70 is greater than the force exerted by the restoring spring 62 on the valve member 61 of the first control valve 60 so that switching the second control valve 70 into its second switching position requires a higher pressure in the actuator pressure chamber 66 and therefore an activation of the actuator 64 with a higher electrical voltage than required to switch the first control valve 60 into its second and third switching positions. It is consequently possible, for a pressure increase in the actuator pressure chamber 66 to switch the first control valve 60 into its second or third switching position while the second control valve 70 remains in its first switching position. With a further pressure increase in the actuator pressure chamber 66, the second control valve 70 is also switched into its second switching position.

The function of the fuel injection device will be explained below. The shared actuator 64 of the control valves 60, 70 is activated by means of an electrical control unit 74. During the intake stroke of the pump piston 18, the first control valve 60 is disposed in its first switching position so that the connection between the line part 56 and the fuel tank 24 is open and no high pressure can build up in the pump working chamber 22 and in the pressure chamber 40 of the fuel injection valve 12. The second control valve 70 is likewise disposed in its first switching position so that the control pressure chamber 52 is shut off from the pump working chamber 22.

Figure 2:
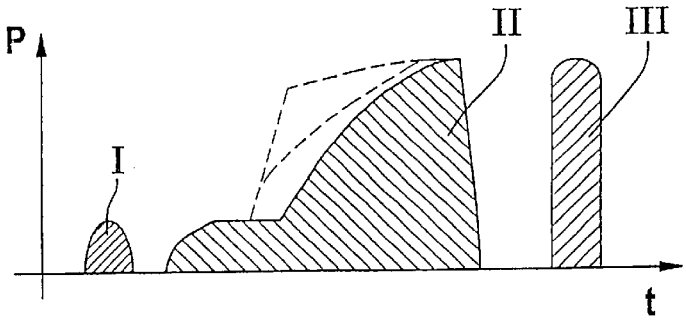

When the injection is to begin, the control unit 74 activates the actuator 64 in such a way that the pressure in the actuator pressure chamber 66 builds up until the first control valve 60 is switched into its second or third switching position. The pump working chamber 22 is then only connected to the discharge chamber 24 via the throttle restriction 63 or is shut off from it so that an increased pressure builds up in the pump working chamber 22 and in the pressure chamber 40. When the force that the pressure prevailing in the pressure chamber 40 exerts on the injection valve member 28 via the pressure shoulder 42 is greater than the force on the injection valve member 28 generated by the closing spring 44, then the injection valve member 28 moves in the opening direction 29 and unblocks the at least one injection opening 32 through which fuel is injected into the combustion chamber of the engine cylinder. The fuel injection here is executed as a preinjection at a relatively low pressure and a low quantity. FIG. 2 plots the march of pressure P prevailing at the injection openings 32 of the fuel injection valve 12 during an injection cycle over time t. The preinjection is labeled I in FIG. 2. During the preinjection, the second control valve 70 remains in its first switching position so that the control pressure chamber 52 is shut off from the pump working chamber 22 and high pressure does not prevail in the control pressure chamber 52.

In order to terminate the preinjection, through an appropriate reduction of the voltage applied to the actuator 64 and thereby a reduced pressure in the actuator pressure chamber 66, the first control valve 60 is switched back into its first switching position so that the pump working chamber 22 is connected to the discharge chamber 24 in an unthrottled manner and the pressure in it drops so that the fuel injection valve 12 closes due to the force of the closing spring 44. To initiate a subsequent main injection, the control unit 74 first acts on the actuator 64 with an electrical voltage, which is powerful enough that the pressure in the actuator pressure chamber 66 increases sufficiently to cause the first control valve 60 to switch into its second switching position and the pump working chamber 22 is connected to the discharge chamber 24 via the throttle restriction 63. Consequently, high pressure builds up in the pump working chamber 22 and in the pressure chamber 40 in accordance with the profile of the cam 20, but is reduced slightly by the throttled connection to the discharge chamber 24. If the force acting on the injection valve member 28 via the pressure shoulder 42 due to the pressure prevailing in the pressure chamber 40 is greater than the force exerted on the injection valve member 28 by the closing spring 44, then the injection valve member 28 moves in the opening direction 29 and unblocks the at least one injection opening 32, through which fuel is injected into the combustion chamber of the engine cylinder. The main injection, which is labeled II in FIG. 2, consequently begins with a relatively low pressure and a low injection quantity. With a chronological delay, the control unit 74 applies an increased electrical voltage to the actuator 64 so that the pressure in the actuator pressure chamber 66 increases sufficiently to cause the first control valve 60 to switch into its third switching position and the pump working chamber 22 is shut off from the discharge chamber 24. Consequently, a further increasing high pressure builds up in the pump working chamber 22 and in the pressure chamber 40 in accordance with the profile of the cam 20, so that the remaining main injection occurs at high pressure and with a large injection quantity. The pressure at which the fuel injection valve 12 opens for the main injection can be influenced by the time that the first control valve 60 switches into its second and/or third switching position. The later the control valve 60 is switched, the higher the pressure at which the main injection begins.

In order to terminate the main injection, the control unit 74 applies an even further increased voltage to the actuator 64 so that the pressure in the actuator pressure chamber 66 is high enough for the second control valve 70 to switch into its second switching position. The first control valve 60 remains in its third switching position so that the pump working chamber 22 is shut off from the discharge chamber 24. The high pressure now prevailing in the control pressure chamber 52, which acts on the piston 48 and works in concert with the closing spring 44, closes the fuel injection valve 12. Then a secondary injection occurs, which is labeled III in FIG. 2, by virtue of the fact that the control unit 74 applies a lower voltage to the actuator 64 again so that the pressure in the actuator pressure chamber 66 drops sharply enough to switch the second control valve 70 into its first switching position and the control pressure chamber 52 is shut off from the pump working chamber 22. The first control valve 60 remains in its third switching position during the secondary injection, so that the pump working chamber 22 is shut off from the discharge chamber 24 and the secondary injection takes place with a march of pressure that corresponds to the profile of the cam 20. In order to terminate the secondary injection, the control unit 74 applies an even lower voltage to the actuator 64 so that the pressure in the actuator pressure chamber 66 is low enough for the first control valve 60 to switch into its first switching position in which the pump working chamber 22 is connected to the discharge chamber 24. The second control valve 70 is then disposed in its first switching position in which the control pressure chamber 52 is shut off from the pump working chamber 22.

FIG. 3 shows a detail of the fuel injection device according to a design that was actually constructed. The structural unit comprised of the fuel pump 10 and the fuel injection valve 12 has the valve body 26 to which a pump body 11 is connected, which contains the cylinder 16 in which the pump piston 18 is guided. The pump body 11 and/or the valve body 26 contains a conduit 80 that leads from the pump working chamber 22 and branches to both of the control valves 60, 70. The two control valves 60, 70 are disposed next to each other, the movement direction of their piston-shaped valve members 61, 71 being at least approximately parallel to each other and parallel to the movement direction of the pump piston 18. The control valves 60, 70 are disposed between the fuel pump 10 and the fuel injection valve 12. The actuator pressure chamber 66 into which the ends of the valve members 61, 71 of the control valves 60, 70 protrude is disposed in the valve body 26, between the control valves 60, 70 and the pump working chamber 22. The valve members 61, 71 are consequently acted on at their end faces by the pressure prevailing in the actuator pressure chamber 66. The actuator pressure chamber 66 is connected via a conduit 82 to a working chamber 84, which is at least indirectly delimited by the actuator 64. Depending on its longitudinal expansion, which is a function of the voltage applied to it, the actuator 64 displaces fuel from the working chamber 84 and thereby changes the pressure in the actuator pressure chamber 66. The actuator 64 is disposed next to the fuel pump 10 and its longitudinal span extends, for example, inclined in relation to the movement direction of the pump piston 18.

The valve members 61, 71 of the control valves 60, 70 are each guided in a cylinder bore 86, 87, with their end faces oriented away from the actuator pressure chamber 66 respectively engaged by the restoring spring 62, 72. The valve member 61 of the first control valve 60 has a section 61*a*, which is guided in a sealed fashion in a section 86*a* of the cylinder bore 86, which leads to the actuator pressure chamber 66, and has a section 61*b*, which is disposed in a section 86*b* of the cylinder bore 86 oriented toward the restoring spring 62. The diameter of the section 86*a* of the cylinder bore 86 and the section 61*a* of the valve member 61 is greater than the diameter of the section 86*b* of the cylinder bore 86 and the section 61*b* of the valve member 61. Between the sections 61*a* and 61*b*, the diameter of the valve member 61 is reduced in a section 61*c*, where at the transition from the section 61*a* to the section 61*c*, an e.g. conical sealing surface 88 is embodied, which is disposed in a chamber 90 formed by a cross sectional enlargement of the cylinder bore 86. A valve seat 89, which is conical for example, is embodied at the transition from the chamber 90 to the section 86*b* of the cylinder bore 86. The chamber 90 opens out into the conduit 80 to the pump working chamber 22 and the conduit 54 leads from the chamber 90 into the pressure chamber 40. From the section 86*b* of the cylinder bore 86, a conduit 91 leads to the fuel tank 24, which functions as a discharge chamber. The region of the section 86*b* of the cylinder bore 86 containing the restoring spring 62 is likewise connected to the fuel tank 24, which functions as a discharge chamber. The valve member 61 of the first control valve 60 controls a connection of the chamber 90 and therefore the pump working chamber 22 to the fuel tank 24, which functions as a discharge chamber. When the pressure in the actuator pressure chamber 66 is low, the valve member 61 is pushed into the actuator pressure chamber 66 by the restoring spring 62, into its first switching position, in which its sealing surface 88 is spaced apart from the valve seat 89 so that an annular gap, which is formed between the section 61*c* of the valve member 61 and the section 86*b* of the cylinder bore 86, connects the chamber 90 to the conduit 91 leading away from this cylinder bore, and to the fuel tank 24. When the pressure in the actuator pressure chamber 66 is increased, then the valve member 61 moves counter to the force of the restoring spring 62 into its second switching position in which the valve member 61 still does not rest with its sealing surface 88 against the valve seat 89 and the chamber 90 is connected via the throttle restriction 63 to the section 86*b* of the cylinder bore 86 and from this cylinder bore, via the conduit 91, to the fuel tank 24. The throttle restriction 63 in this instance can be embodied between the sealing surface 88 and the valve seat 89. When the pressure in the actuator pressure chamber 66 is increased further, then the valve member 61 is moved into its third switching position in which it rests with its sealing surface 88 against the valve seat 89 and the chamber 90 is consequently shut off from the fuel tank 24.

The cylinder bore 87 that contains the valve member 71 of the second control valve 70 has a section 87*a* that opens out into the actuator pressure chamber 66 and a section 87*b* at the opposite end that contains the restoring spring 72. Between the sections 87*a* and 87*b* of the cylinder bore 87, a radial enlargement forms a chamber 92 from which a conduit 93 leads to the control pressure chamber 52. The valve member 71 has a section 71*a* that is disposed in the section 87*a* of the cylinder bore 87 and a section 71*b* that is guided in a sealed fashion in the section 87*b* of the cylinder bore 87. Between the sections 71*a* and 71*b*, the valve member 71 has a section 71*c* with a reduced diameter. At the transition from the section 71*b* to the section 71*c* of the valve member 71, the valve member has a sealing surface 94 that is conical, for example. A valve seat 95, which is conical for example, is provided in the section 87*a* of the cylinder bore 87, at the transition into the chamber 92. The conduit 80 leading to the pump working chamber 22 feeds into the section 87*a* of the cylinder bore 87. The region of the section 87*b* of the cylinder bore 87, which contains the restoring spring 72, is connected to the fuel tank 24, which functions as a discharge chamber. When the force exerted on the valve member 71 by the restoring spring 72 is greater than the force exerted on the valve member 71 by the pressure prevailing in the actuator pressure chamber 66, then the valve member 71 is disposed in its first switching position, in which it rests with its sealing surface 94 against the valve seat 95. The chamber 92 and therefore the control pressure chamber 52 are consequently shut off from the pump working chamber 22. If the pressure in the actuator pressure chamber 66 is high enough that the force it exerts on the valve member 71 is greater than the force of the restoring spring 72, then the valve member 71 moves into its second switching position in which its sealing surface 94 is lifted up from the valve seat 95 and the chamber 92 is connected to the conduit 80 and therefore to the pump working chamber 22 via an annular gap between the section 71*c* of the valve member 71 and the section 87*a* of the cylinder bore 87.

The foregoing relates to preferred exemplary embodiments of the invention, it being understood that other variants and embodiments thereof are possible within the spirit and scope of the invention, the latter being defined by the appended claims.

I claim:

1. A fuel injection device for an internal combustion engine, comprising, a fuel pump (10) for each cylinder of the engine, which fuel pump has a pump piston (18) that is driven in a stroke motion by the engine and delimits a pump working chamber (22), a fuel injection valve (12) connected to the pump working chamber and constituting a structural unit with the fuel pump (10), the injection valve having an injection valve member (28), which controls at least one injection opening (32) and which can be moved in the opening direction (29) counter to a closing force by the pressure prevailing in a pressure chamber (40) connected to the pump working chamber (22), a first electrically actuated control valve (60) which at least indirectly controls a connection of the pump working chamber (22) to a discharge chamber (24), a second electrically actuated control valve (70) which controls a connection of a control pressure chamber (52) of the fuel injection valve (12) to the pump working chamber (22), the pressure prevailing in the control pressure chamber (52) acting at least indirectly on the injection valve member (28) in the closing direction, the control valves (60, 70) being actuated by a shared actuator (64), the actuator (64) controling the pressure in an actuator pressure chamber (66) and the two control valves (60, 70) each having a valve member (61, 71) that is acted on by the pressure prevailing in the actuator pressure chamber (66).

2. The fuel injection device according to claim 1 wherein, when the actuator pressure chamber (66) is not pressurized, the second control valve (70) is disposed in a switching position in which the control pressure chamber (52) is shut off from the pump working chamber (22).

3. The fuel injection device according to claim 1 wherein the control pressure chamber (52) has a continuously open connection to a discharge chamber (24), which contains at least one throttle restriction (63).

4. The fuel injection device according to claim 2 wherein the control pressure chamber (52) has a continuously open connection to a discharge chamber (24), which contains at least one throttle restriction (63).

5. The fuel injection device according to claim 1 wherein the two control valves (60, 70) are disposed next to each other.

6. The fuel injection device according to claim 2 wherein the two control valves (60, 70) are disposed next to each other.

7. The fuel injection device according to claim 3 wherein the two control valves (60, 70) are disposed next to each other.

8. The fuel injection device according to claim 4 wherein the two control valves (60, 70) are disposed next to each other.

9. The fuel injection device according to claim 1 wherein the first control valve (60) is embodied as a 2/3-port directional-control valve, which, in a first switching position when there is a low pressure in the actuator pressure chamber (66), opens an unthrottled connection of the pump working chamber (22) to the discharge chamber (24), which, in a second switching position when there is an increased pressure in the actuator pressure chamber (66), opens a connection containing a throttle restriction (63) between the pump working chamber (22) and the discharge chamber (24), and which, in a third switching position, when there is a further increased pressure in the actuator pressure chamber (66), shuts off the pump working chamber (22) from the discharge chamber (24).

10. The fuel injection device according to claim 2 wherein the first control valve (60) is embodied as a 2/3-port directional-control valve, which, in a first switching position when there is a low pressure in the actuator pressure chamber (66), opens an unthrottled connection of the pump working chamber (22) to the discharge chamber (24), which, in a second switching position when there is an increased pressure in the actuator pressure chamber (66), opens a connection containing a throttle restriction (63) between the pump working chamber (22) and the discharge chamber (24), and which, in a third switching position, when there is a further increased pressure in the actuator pressure chamber (66), shuts off the pump working chamber (22) from the discharge chamber (24).

11. The fuel injection device according to claim 3 wherein the first control valve (60) is embodied as a 2/3-port directional-control valve, which, in a first switching position when there is a low pressure in the actuator pressure chamber (66), opens an unthrottled connection of the pump working chamber (22) to the discharge chamber (24), which, in a second switching position when there is an increased pressure in the actuator pressure chamber (66), opens a connection containing a throttle restriction (63) between the pump working chamber (22) and the discharge chamber (24), and which, in a third switching position, when there is a further increased pressure in the actuator pressure chamber (66), shuts off the pump working chamber (22) from the discharge chamber (24).

12. The fuel injection device according to claim 4 wherein the first control valve (60) is embodied as a 2/3-port directional-control valve, which, in a first switching position when there is a low pressure in the actuator pressure chamber (66), opens an unthrottled connection of the pump working chamber (22) to the discharge chamber (24), which, in a second switching position when there is an increased pressure in the actuator pressure chamber (66), opens a connection containing a throttle restriction (63) between the pump working chamber (22) and the discharge chamber (24), and which, in a third switching position, when there is a further increased pressure in the actuator pressure chamber (66), shuts off the pump working chamber (22) from the discharge chamber (24).

13. The fuel injection device according to claim 1 wherein the actuator (64) is a piezoelectric actuator.

14. The fuel injection device according to claim 2 wherein the actuator (64) is a piezoelectric actuator.

15. The fuel injection device according to claim 3 wherein the actuator (64) is a piezoelectric actuator.

16. The fuel injection device according to claim 5 wherein the actuator (64) is a piezoelectric actuator.

17. The fuel injection device according to claim 9 wherein the actuator (64) is a piezoelectric actuator.

18. The fuel injection device according to claim 1 wherein the valve members (61, 71) of the two control valves (60, 70) can each be moved counter to the force of a restoring spring (62, 72), and that the force of the restoring spring (72) acting on the valve member (71) of the second control valve (70) is greater than the force of the restoring spring (62) acting on the valve member (61) of the first control valve (60).

* * * * *